United States Patent [19]

Beier

[11] Patent Number: 4,756,035

[45] Date of Patent: Jul. 12, 1988

[54] ORTHOPEDIC PILLOW

[76] Inventor: John K. Beier, 901 S. 89th, Omaha, Nebr. 68114

[21] Appl. No.: 74,891

[22] Filed: Jul. 17, 1987

[51] Int. Cl.[4] ..... A47C 20/02

[52] U.S. Cl. ..... 5/437; 5/441; 5/442

[58] Field of Search ..... 5/447, 462, 434, 437, 5/441, 442, 464, 465

[56] References Cited

U.S. PATENT DOCUMENTS

| | | | |
|---|---|---|---|
| 2,815,515 | 12/1957 | McKinley | 5/442 |
| 3,148,389 | 9/1984 | Lustig . | |
| 3,243,828 | 4/1966 | McCarty | 5/437 |
| 3,667,074 | 6/1972 | Emery . | |
| 3,840,918 | 10/1974 | Shave . | |
| 4,277,859 | 7/1981 | Seaman | 5/434 |
| 4,365,371 | 12/1982 | Boussaroque | 5/462 |
| 4,494,261 | 1/1985 | Morrow | 5/436 |
| 4,513,462 | 4/1985 | Thomas | 5/442 |
| 4,528,705 | 7/1985 | Greenawalt | 5/441 |
| 4,574,411 | 3/1986 | Yagi | 5/434 |

FOREIGN PATENT DOCUMENTS

| | | | |
|---|---|---|---|
| 923758 | 4/1963 | United Kingdom | 5/462 |

*Primary Examiner*—Michael F. Trettel

*Attorney, Agent, or Firm*—Zarley, McKee, Thomte, Voorhees & Sease

[57] ABSTRACT

An orthopedic pillow comprising an outer pillow case defining first and second compartments therein. A fibrous material is positioned in the first compartment to provide a head cushion. An elongated resilient block member is positioned in the second compartment for supporting a person's neck. The firmness of the head and neck cushion may be selectively varied.

9 Claims, 4 Drawing Sheets

ORTHOPEDIC PILLOW

BACKGROUND OF THE INVENTION

This invention relates to an orthopedic pillow and more particularly to an orthopedic pillow having head and neck cushions enclosed within a pillow case.

Many types of orthopedic pillows or head and neck cushions have been previously provided. For example, in U.S. Pat. No. 4,494,261, a composite head and neck cushion is provided. In U.S. Pat. No. 4,494,261, a first resilient cushion member supports the neck of the person while a second cushion member supports the head of the user. A disadvantage of the cushion or pillow of the type described in U.S. Pat. No. 4,494,266 is that the resiliency or firmness of the cushions cannot be varied or adjusted dependent upon a particular person's desires or needs.

It is therefore a principal object of this invention to provide an improved orthopedic pillow.

A further object of the invention is to provide an orthopedic pillow which may be adjusted to change the firmness of the cushion members.

A further object of the invention is to provide an orthopedic pillow including means for increasing the firmness or decreasing the firmness of the pillow.

Yet another object of the invention is to provide an orthopedic pillow of the type described including means for conveniently varying the firmness of the pillow.

These and other objects will be apparent to those skilled in the art.

SUMMARY OF THE INVENTION

An orthopedic pillow is described which is comprised of an outer pillow case having a head cushion and a neck cushion positioned therein. The head cushion is comprised of a fibrous material which is held in place within the pillow case by a plurality of straps. The amount of the fibrous material may be varied to increase or decrease the firmness of the head cushion.

The neck cushion is comprised of a substantially rectangular block member comprised of a foam material. The block member is partially split along a horizontal plane to define upper and lower block portions which are pivotally joined along their upper ends. A plurality of removable members are positioned between the block portions so that they may be removed to decrease the firmness of the neck cushion if desired. Further, elongated stiffening members may be positioned between the block portions to increase the firmness of the neck cushion as desired. Access to the interior of the pillow case is gained by way of a zipper extending along the lower end thereof. A modified form of the invention is also described within a block member, having removable members therein, occupies the entire interior of the pillow.

DESCRIPTION OF THE PREFERRED EMBODIMENT

Figure 3:
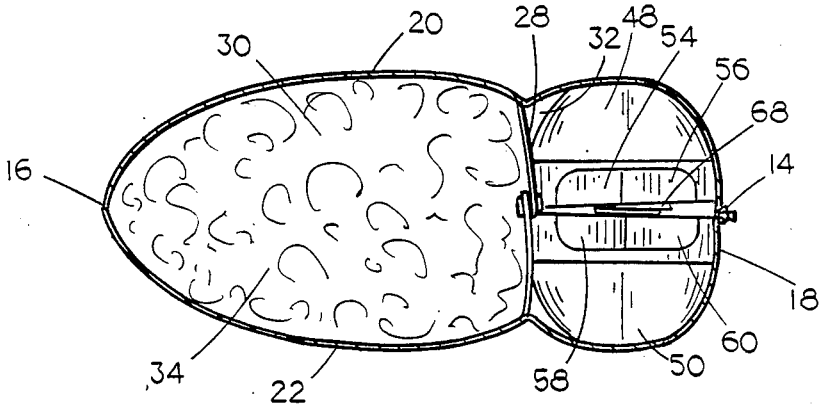
FIG. 3 is a transverse sectional view of the pillow.
Figure 4:
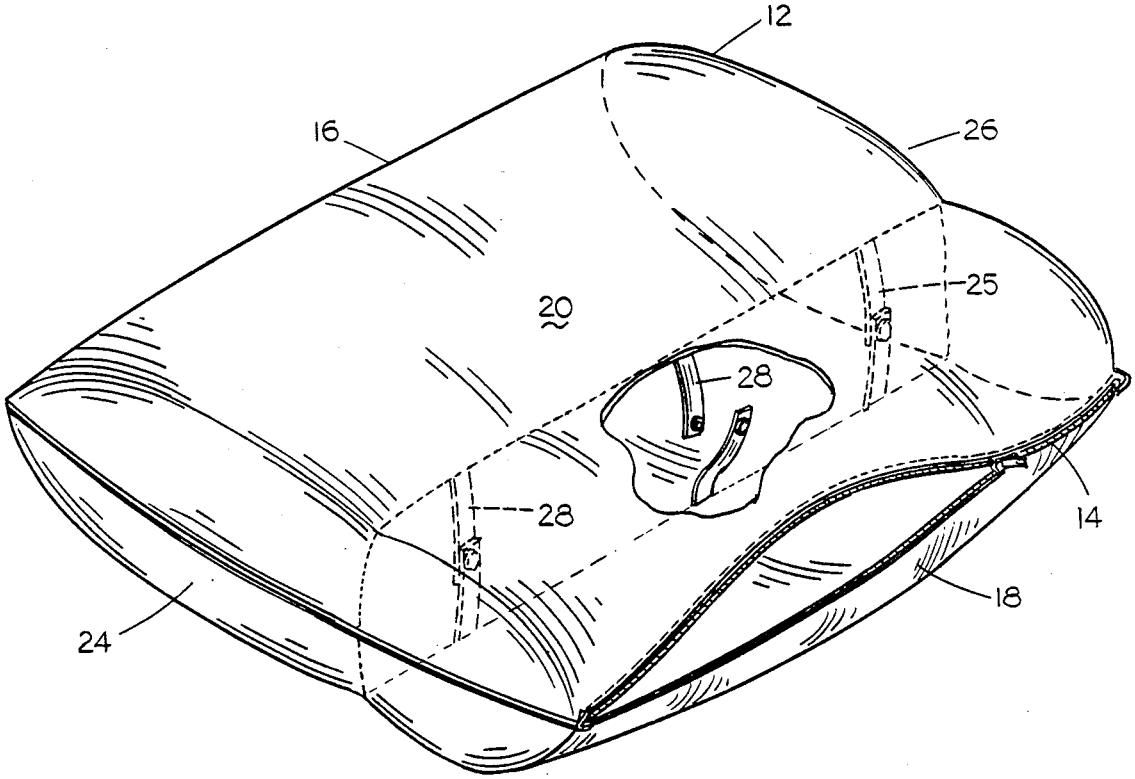
FIG. 4 is a view similar to FIG. 2 but which is represented in an elevational view to illustrate the internal components of the pillow as well as a portion thereof being broken away to more fully illustrate the invention.
Figure 5:
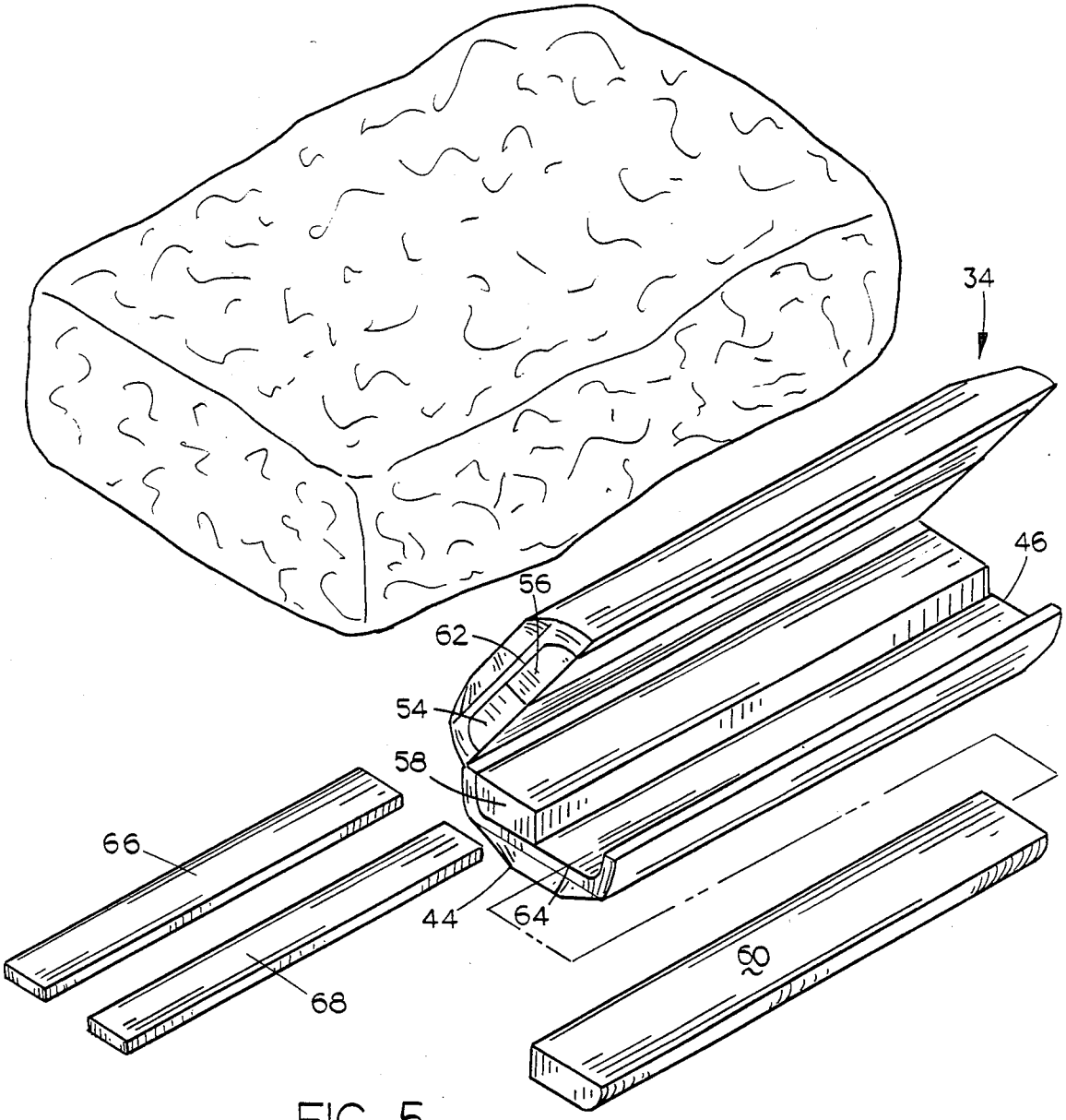
FIG. 5 is an exploded perspective view of the internal components of the pillow.
Figure 6:
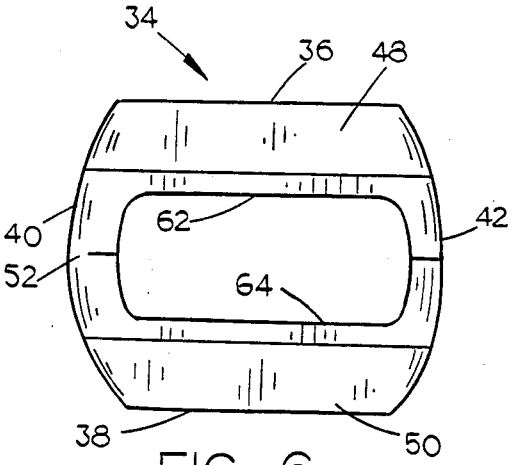
FIG. 6 is an end view of the neck cushion with the removable members removed therefrom.

The pillow of this invention is referred to generally by the reference numeral 10 and is comprised of an outer pillow case 12 having a zipper 14 at its lower edge. For purposes of description, the pillow 10 will be described as having an upper end 16, lower end 18, top portion 20, bottom portion 22 and opposite sides 24 and 26. A plurality of straps 28 extend between top portion 20 and bottom portion 22 as illustrated in FIGS. 3 and 4 to divide the interior of the pillow case 12 into compartments 30 and 32.

Figure 1:
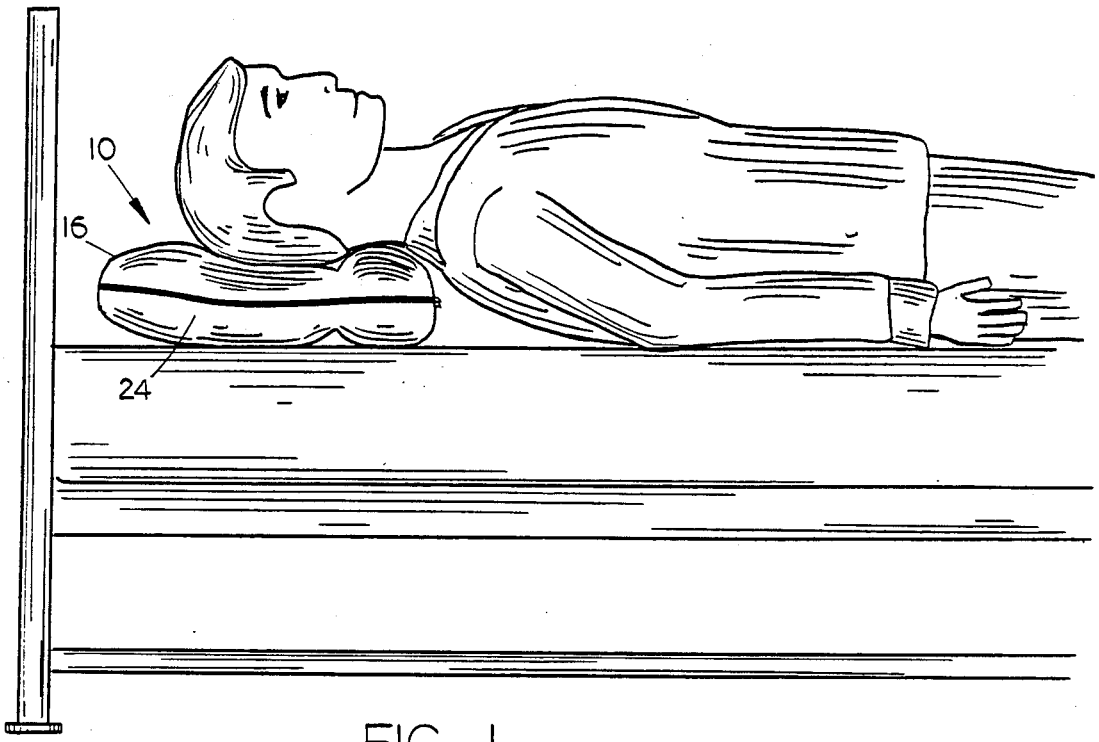
FIG. 1 is a side view illustrating a person utilizing the pillow of this invention.
Figure 2:
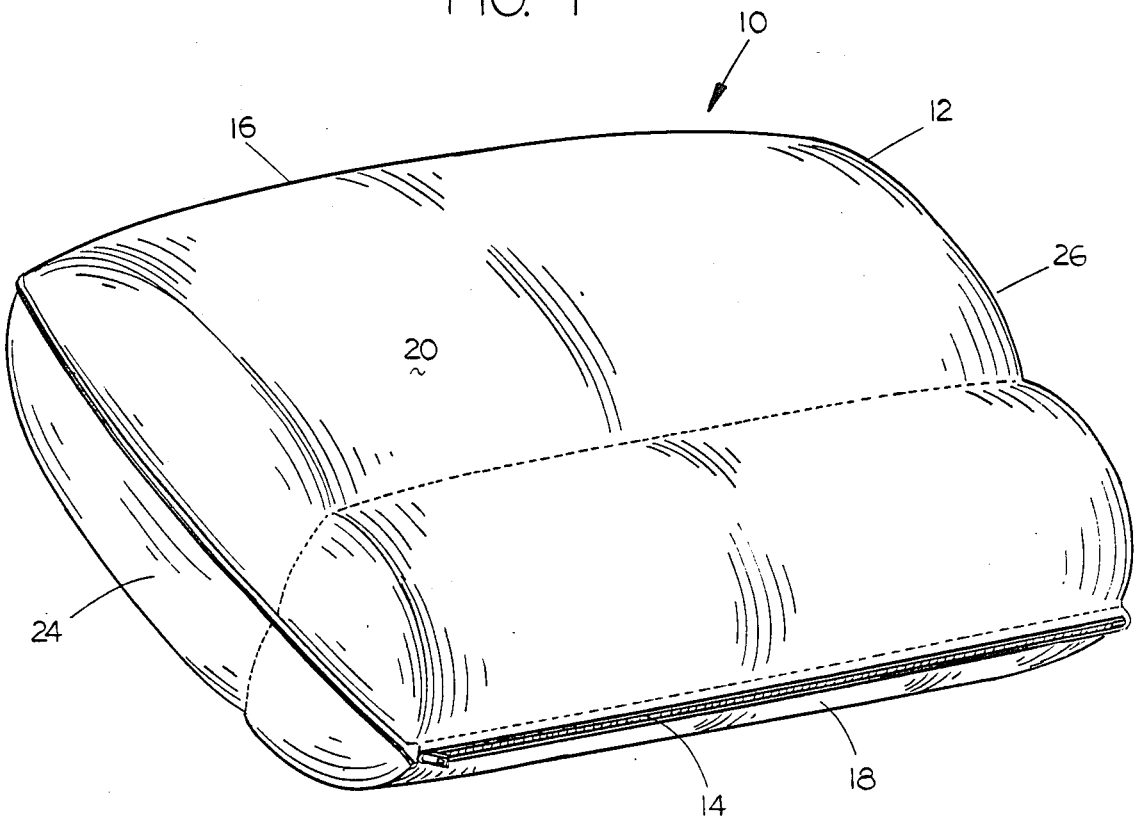
FIG. 2 is a perspective view of the pillow of this invention.

Compartment 30 is filled with a fibrous material referred to generally by the reference numeral 33 and the amount of the same may be varied to increase or decrease the firmness of that portion of the pillow which will support the head as illustrated in FIG. 1. Resilient straps 28, including snaps or other connection means, serve to maintain the fibrous material 33 in the compartment 30 to prevent the migration of the same into the compartment 32. The resiliency of the straps 28 permits the straps to accommodate various thicknesses of the fibrous material 33.

An elongated, generally rectangular block member 34, preferably comprised of a resilient urethane foam material, is positioned within compartment 32 and will be described as comprising a top portion 36, bottom portion 38, upper end 40, lower end 42, and opposite ends 44 and 46. Block member 34 is split along a horizontal plane from one end of the block member to the other as illustrated in the drawings to define upper and lower block portions 48 and 50. As seen in the drawings, the split between block portions 48 and 50 does not extend completely therethrough but terminates adjacent the upper end thereof to provide a "pivotal" connection in the vicinity of the area identified by the reference numeral 52 to permit the block portions 48 and 50 to be pivotally moved or opened with respect to each other.

Block member 48 is provided with four removable segments 54, 56, 58 and 60 removably positioned therein. As seen in the drawings, the members 54 and 56 are positioned in a recess 62 while the members 58 and 60 are positioned in a recess 64.

Figure 7:
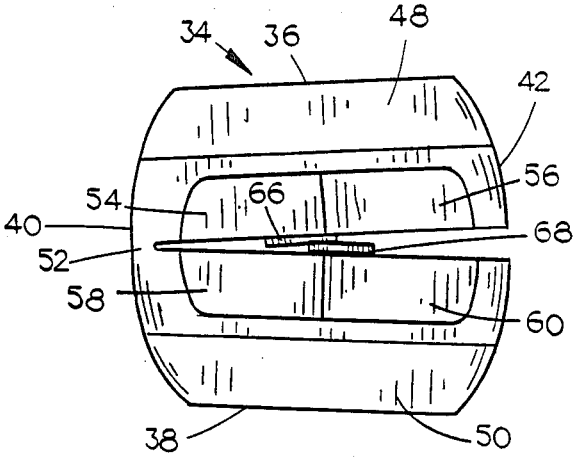
FIG. 7 is an end view of the neck cushion illustrating the members positioned therein to increase the firmness of the cushion.

When block member 34 is positioned in compartment 32 and the zipper 14 is closed, the block member 34 will support the neck of the person utilizing the same. If it is desired to decrease the firmness of the block member 34, one or more of the members 54, 56, 58 and 60 may be removed from the block member as required. If it is desired to increase the firmness of the block member 34, one or more of the stiffening members 66 and 68 may be positioned between the members 54, 56 and 58, 60 as illustrated in FIG. 7.

It is recommended that the block member 34 be comprised of a urethane foam as would be the members 54, 56, 58 and 60. It is preferred that the members 66 and 68 be comprised of a more rigid foam material than that of the block member 34.

The zipper 14 provides convenient access to the interior of the pillow case. When it is desired to vary the firmness of the block member 34, the zipper 14 is opened which provides convenient access to the open end of the block member 34 so that the firmness of the same may be varied without removing the block member 34 from the interior of the pillow, if desired.

If it is desired to vary the firmness of the fibrous material 33, zipper 14 is opened, and block member 34 is removed. Straps 28 are then "unsnapped" and material is either added to compartment 30 or removed therefrom through the opening created by the zipper 14. Once the firmness has been changed, the straps 28 are refastened, block member 34 reinserted, and zipper 14 closed.

Figure 8:
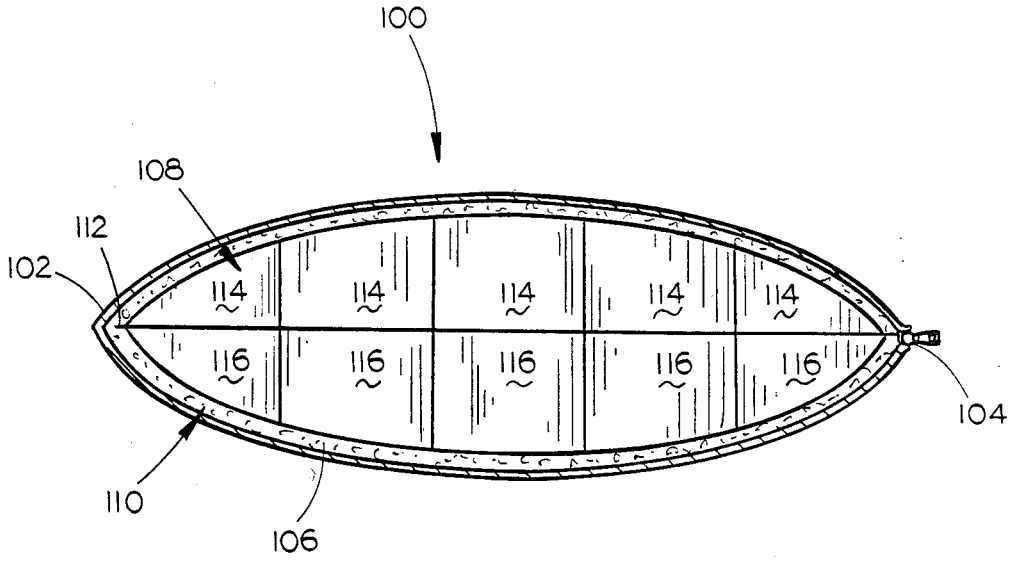
FIG. 8 is a sectional view of a modified form of the invention.

A modified form of the pillow is illustrated in FIG. 8 although the pillow shown in FIGS. 1–7 is the preferred embodiment. Pillow 100 in FIG. 8 includes a pillow case 102 having a zipper 104 at one end thereof permitting access to the interior of the pillow case 102. Positioned within pillow case 102 is a generally rectangular block member 106 which is preferably comprised of a resilient urethane foam material. Block member 106 is split along a horizontal plane from one end of the block member to the other to define upper and lower block portions 108 and 110 respectively. As seen in FIG. 8, the split between block portions 108 and 110 does not extend completely therethrough but terminates adjacent the upper end thereof to provide a "pivotal" connection in the vicinity of the area identified by the reference numeral 112 to permit the block portions 108 and 110 to be pivotally moved or opened with respect to each other.

Block portion 108 is provided with a plurality of removable segments 114 removably positioned therein while block portion 110 is provided with a plurality of removable segments 116 removably positioned therein.

Any number of the segments 114 and 116 may be removed from the pillow 100 to permit the user to decrease the "firmness" or effective thickness of the pillow as desired.

Thus it can be seen that a unique orthopedic pillow has been provided which not only supports the head and neck of a person but which also may be modified in a convenient manner to vary the firmness of the same. Thus it can be seen that the pillow of this invention accomplishes at least all of its stated objectives.

I claim:

1. An orthopedic pillow, comprising, an outer pillow case having upper and lower ends, a top, a bottom, and opposite side edges, said pillow case having first and second compartments defined therein which extend between said opposite side edges, a quantity of fibrous material in said first compartment, an elongated resilient block member in said second compartment and having upper and lower ends, opposite side edges, a top and a bottom, said block member being at least partially longitudinally split along a horizontal plane to define upper and lower block portions, and means removably positioned between said block portions whereby the firmness of said block member may be selectively varied.

2. The pillow of claim 1 wherein said block portions are pivotally joined together.

3. The pillow of claim 1 wherein said means removably positioned between said block portions comprises elongated flat strips of material.

4. The pillow of claim 1 wherein at least one of said upper and lower block portions is provided with removable segments to permit the firmness of the block portion to be selectively varied.

5. The pillow of claim 1 wherein a plurality of resilient straps extend between the top and bottom of said pillow case to define said first and second compartments.

6. The pillow of claim 5 wherein said straps may be separated to permit convenient access to said first compartment.

7. The pillow of claim 1 wherein a zipper is provided along said lower end of said pillow case.

8. A pillow comprising, an outer pillow case having upper and lower ends, a top, a bottom, and opposite side edges, a resilient block member in said pillow case and having upper and lower ends, a top, a bottom, and opposite side edges, said block member being at least partially split along a horizontal plane to define upper and lower block portions, the horizontally extending split extending between said opposite side edges, at least one of said block portions having removable segments positioned therein to permit the firmness of the pillow to be selectively varied, said removable segments having a firmness greater than said block member.

9. An orthopedic pillow, comprising, an outer pillow case having upper and lower ends, a top, a bottom, and opposite side edges, said pillow case having first and second compartments defined therein which extend between said opposite side edges, a quantity of fibrous material in said first compartment, an elongated resilient block member in said second compartment and having upper and lower ends, opposite side edges, a top and a bottom, said block member being at least partially longitudinally split along a horizontal plane to define upper and lower block portions, at least one of said upper and lower block portions being provided with removable segments to permit the firmness of the block portion to be selectively varied.

* * * * *